US005470358A

United States Patent [19]

Gaughan

[11] Patent Number: 5,470,358

[45] Date of Patent: Nov. 28, 1995

[54] UNLEADED AVIATION GASOLINE

[75] Inventor: Roger G. Gaughan, Piscataway, N.J.

[73] Assignee: Exxon Research & Engineering Co., Florham Park, N.J.

[21] Appl. No.: 229,503

[22] Filed: Apr. 19, 1994

Related U.S. Application Data

[63] Continuation-in-part of Ser. No. 59,437, May 4, 1993, abandoned.

[51] Int. Cl.[6] ..... C10L 1/22

[52] U.S. Cl. ..... 44/426

[58] Field of Search ..... 44/426

[56] References Cited

U.S. PATENT DOCUMENTS

| | | | |
|---|---|---|---|
| 1,571,862 | 2/1926 | Midgley | 44/426 |
| 1,606,431 | 11/1926 | Hamby et al. | 44/426 |
| 2,398,197 | 4/1946 | Stanly | 44/426 |
| 2,413,262 | 12/1946 | Stirton | 44/69 |
| 2,434,650 | 1/1948 | Herbst | 44/74 |
| 2,819,953 | 1/1958 | Brown | 44/426 |
| 4,294,587 | 10/1981 | Burns | 44/74 |
| 4,321,063 | 3/1982 | Burns | 44/74 |

FOREIGN PATENT DOCUMENTS 275640 3/1992 Czechoslovakia .

*Primary Examiner*—Prince Willis, Jr.
*Assistant Examiner*—Cephia D. Toomer
*Attorney, Agent, or Firm*—James H. Takemoto

[57] ABSTRACT

Aromatic amines of the formula

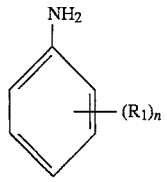

where $R_1$ is $C_1$–$C_{10}$ alkyl or halogen and n is an integer from 0 to 3 are effective in increasing the motor octane number of aviation gasolines to 98 or greater without the presence of lead additives.

11 Claims, No Drawings

UNLEADED AVIATION GASOLINE

This application is a continuation-in-part of U.S. application Ser. No. 059,437 filed May 4, 1993, and now abandoned.

BACKGROUND OF THE INVENTION

1. Field of the Invention

This invention relates to unleaded aviation gasolines. More specifically, this invention is directed to an unleaded aviation gasoline possessing a high motor octane number for use in piston driven aircraft which require high octane fuels.

2. Background of the Invention

The high octane requirements of aviation gas for use in piston driven aircraft which operate under severe requirements, e.g., aircraft containing turbo charged piston engines require that commercial aviation fuels contain a high performance octane booster. The octane boosters for automobile gasolines (Mogas) such as benzene, toluene, xylene, methyl tertiary butyl ether, ethanol and the like are not capable by themselves of boosting the motor octane number (MON) to the 98 to 100 MON levels required for aviation gasolines (Avgas). Tetraethyl lead is therefore a necessary component in high octane Avgas as an octane booster. However, environmental concerns over lead and its compounds may require the phasing out of lead in Avgas.

U.S. Pat. No. 2,819,953 describes aromatic amines added to motor gasolines as antiknock agents. However, motor gasolines have much lower octane requirements than aviation gasolines for piston driven aircraft. One cannot predict performance of a given antiknock agent in an aviation gasoline based on its performance as an antiknock agent in a motor gasoline.

It would be desirable to find a non-lead based octane booster for Avgas which will permit formulation of a high octane Avgas.

SUMMARY OF THE INVENTION

In accordance with the present invention, there is provided a high octane Avgas which contains no lead. More particularly, this invention relates to an unleaded aviation fuel composition having a motor octane number of at least about 98 for piston driven aircraft which comprises:

(1) unleaded aviation gasoline base fuel, and (2) an amount of at least one aromatic amine effective to boost the motor octane number of the base fuel to at least about 98, said aromatic amine having the formula

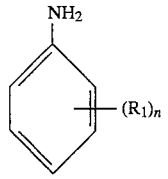

(I)

where $R_1$ is $C_1$–$C_{10}$ alkyl or halogen and n is an integer from 0 to 3 with the proviso that when $R_1$ is alkyl, it cannot occupy the 2- or 6-positions on the aromatic ring. Another embodiment of the invention comprises a method for preparing an unleaded aviation fuel composition having a motor octane number of at least 98 for use in piston driven aircraft which comprises adding an effective amount of octane boosting aromatic amine of the formula (I) to the aviation base fuel. Yet another embodiment relates to a method for operating a piston driven aircraft with an unleaded fuel which comprises operating the piston driven aircraft with an unleaded aviation base fuel containing an amount of at least one aromatic amine of the formula (I) effective to boost the motor octane number of the base fuel to at least about 98.

DETAILED DESCRIPTION OF THE INVENTION

Compositionally, Avgas is different from Mogas. Avgas, because of its higher octane and stability requirements, is a blend of isopentane, alkylate, toluene and tetraethyl lead. A typical Avgas base fuel without octane booster such as tetraethyl lead has a MON of 90 to 93. Mogas, which has lower octane requirements, is a blend of many components such as butane, virgin and rerun naphtha, light, intermediate and heavy cat naphthas, reformate, isomerate, hydrocrackate, alkylate, ethers and alcohols. Octane requirements of Mogas are based on research octane numbers (RON). For a given fuel, the RON is on average 10 octane numbers higher than its corresponding MON. Thus, the average premium Mogas possesses a MON of 86 to 88, whereas current Avgas must have a MON of 98–100. MON, not RON, is the accepted measure of octane for Avgas and is measured using ASTM 2700-92.

Conventional octane booster for Mogas, such as benzene, toluene, xylene, methyl tertiary butyl ether and ethanol are capable of boosting the MON of unleaded Avgas to the 92 to 95 MON range if added to Avgas in high enough concentrations. As noted previously, this is insufficient to meet the needs of high octane Avgas.

The aromatic amines of the present invention are capable of boosting the MON of Avgas to values of 98 or greater. In the aromatic amines of the formula

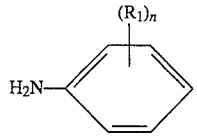

$R_1$ is preferably $C_1$ to $C_5$ alkyl or halogen and n is preferably 1 to 2. Preferred halogens are Cl or F. When $R_1$ is alkyl, it occupies the -3, -4, or -5 (meta or para) positions on the benzene ring. Alkyl groups in the 2- or 6- position result in aromatic amines which cannot boost octane to a MON value of 98. Examples of preferred aromatic amines include phenylamine, 4-tert-butylphenylamine, 3-methylphenylamine, 3-ethylphenylamine, 4-methylphenylamine, 3,5-dimethylphenylamine, 3,4-dimethylphenylamine, 4-isopropylphenylamine, 2-fluorophenylamine, 3-fluorophenylamine, 4-fluorophenylamine, 2-chlorophenylamine, 3-chlorophenylamine and 4-chlorophenylamine. Especially preferred are 3,5-dimethylphenylamine, 3,4-dimethylphenylamine, 2-fluorophenylamine, 4-fluorophenylamine, 3-methylphenylamine, 3-ethylphenylamine, 4-ethylphenylamine, 4-isopropylphenylamine and 4-t-butylphenylamine.

The fuel compositions of this invention may be prepared by blending aviation gasoline with aromatic amines of the formula (I). Preferred concentrations are from 4–20 wt %, based on fuel, more preferably 5–15 wt % and especially 6–10 wt %. It is important that the aromatic amine be soluble in aviation gasoline at the desired concentration. A cosolvent may be added to the Avgas to improve solubility properties. Examples of cosolvents include low molecular weight aromatics, alcohols, nitriles, esters, halogenated hydrocarbons, ethers and the like.

The present aromatic amine additives may be used with conventional octane boosters, such as ethers, alcohols, aromatics and non-lead metals. Examples of such octane boosters include ethyl tertiary, butyl ether, methylcyclopentadienyl manganese tricarbonyl, iron pentacarbonyl, as well as the other boosters noted previously. While such conventional organic octane boosters may be used to increase the MON of Avgas, they are not capable by themselves of boosting the MON to the 98 level required in Avgas for use in piston driven engines. Adding the aromatic amines of this invention to Avgas containing conventional octane booster has only a very slight incremental effect at the 98 MON octane level. Thus there is little economic incentive to combine the present aromatic amines with conventional octane boosters even though technically this can be done.

Other approved additives may be included in the Avgas fuel compositions. Examples of such approved additives include antioxidants and dyes. Approved additives for Avgas are listed in ASTM D-910.

This invention is further exemplified by reference to the examples, which include a preferred embodiment of the invention.

EXAMPLE 1

This example illustrates the effect of N-alkyl substitution on the octane boosting performance of an aromatic amine. The unleaded aviation gasoline employed as base fuel had a MON of 92.6 as determined using ASTM 2700-92. The Avgas was a blend of isopentane, alkylate and toluene. Phenylamine, N-methyl phenylamine and N-ethylphenylamine were blended into the Avgas and the results are shown in Table 1.

TABLE 1

| Test No. | Compound | MON (a) Concentration (b) 0 | 3 | 6 | 9 |
|---|---|---|---|---|---|
| 1 | phenylamine | 92.6 | 95.3 | 98.3 | 101.3 |
| 2 (c) | N-methylphenylamine | 92.6 | 94.6 | 94.7 | 95.2 |
| 3 (c) | N-ethylphenylamine | 92.6 | 90.4 | 90.1 | — |

(a) Motor octane numbers determined using ASTM 2700-88(a)
(b) Concentrations based on wt % in Avgas
(c) Comparative data These results demonstrate that substituents on the amino moiety decrease the octane boosting performance over the unsubstituted amino moiety. In fact, going from methyl to ethyl results in a negative effect. Phenylamine itself results in a 98 MON value at about a 6 wt % concentration whereas comparative tests 2 and 3 with N-alkyl substitution results in Avgas which will not achieve a 98 MON value even at high additive concentrations.

EXAMPLE 2

In this example, various alkyl substituted phenylamines were blended into the unleaded Avgas of Example 1 having a MON of 92.6. The results are shown in Table 2.

TABLE 2

| Test No. | Compound | MON Concentrations (a) 3 | 6 | 9 |
|---|---|---|---|---|
| 4 | 3-methylphenylamine | 96.6 | 98.0 | 100.0 |
| 5 | 3-ethylphenylamine | — | 96.4 | 99.2 |
| 6 | 4-methylphenylamine | 96.8 | 98.7 | (b) |
| 7 | 4-isopropylphenylamine | 95.3 | 97.0 | 99.8 |
| 8 | 4-tertiarybutylphenylamine | 94.6 | 96.8 | 99.2 |
| 9 | 3,4-dimethylphenylamine | 94.6 | 98.2 | (b) |
| 10 | 3,5-dimethylphenylamine | 95.0 | 98.3 | 101.3 |
| | Comparative Tests | | | |
| 11 | 2-methylphenylamine | 94.2 | 94.3 | 94.7 |
| 12 | 2-ethylphenylamine | — | 91.2 | 90.9 |
| 13 | 2-isopropylphenylamine | 91.4 | 90.4 | 91.2 |
| 14 | 2,5-dimethylphenylamine | 93.4 | 95.6 | 95.6 |

(a) Concentrations based on wt % in Avgas
(b) Not fully soluble at this concentration As can been seen from this data, alkyl substituents in the 3-, 4-, or 5- positions are effective at boosting MON values to 98 whereas alkyl substituents in the 2- or 6- (ortho) positions are not effective in boosting the MON to 98. In fact, bulky ortho substituents such as 2-isopropyl have a negative effect on octane performance. In the case where there are alkyl substituents in the 2- and 3-, 4- or 5-positions, the 2-position substituent limits the octane boosting value. Thus in comparing tests 10 and 14, only the 3,5-dimethyl isomer is capable of boosting octane values to 98. This is further illustrated in Table 3 in which mixtures of 2-, 3- and 4-methylphenylamines are compared.

TABLE 3

| Test No. | Compound | Component (a) Percent | Total Percent | MON |
|---|---|---|---|---|
| 15 | 2-methylphenylamine | 2 | 6 | 96.4 |
| | 3-methylphenylamine | 2 | | |
| | 4-methylphenylamine | 2 | | |
| 16 | 2-methylphenylamine | 3 | 6 | 95.6 |
| | 3-methylphenylamine | 3 | | |
| 17 | 2-methylphenylamine | 3 | 9 | 97.3 |
| | 3-methylphenylamine | 3 | | |
| | 4-methylphenylamine | 3 | | |
| 18 | 2-methylphenylamine | 4.5 | 9 | 96.5 |
| | 3-methylphenylamine | 4.5 | | |

(a) Concentrations based on wt % in Avgas

The data in Table 3 shows that the octane boosting effect is due to the 3- and 4-isomers whereas the 2-isomer is a limiting factor. Thus in comparing Tests 15 and 16 or Tests 17 and 18, it can be seen that increasing the amount of the 2-isomer at a constant total percentage results in a decrease in MON. This is consistent with Test 11 which shows little octane boosting effect for the 2-isomer as compared to the 3- and 4-isomers shown in Tests 4 and 6.

EXAMPLE 3

This example compares the octane boosting performance of various halogen substituted phenylamines and mixed halogen and alkyl substituted phenylamines when blended into an unleaded Avgas having a MON of 92.6. The results are shown in Table 4.

TABLE 4

| Test No. | Compound | MON Concentrations (a) 3 | 6 | 9 |
|---|---|---|---|---|
| 19 | 2-fluorophenylamine | 94.2 | 96.8 | 99.9 |
| 20 | 3-fluorophenylamine | 94.1 | 96.8 | 99.3 |
| 21 | 4-fluorophenylamine | 95.4 | 96.8 | 100.1 |
| 22 | 2-chlorophenylamine | 93.8 | 97.1 | 98.2 |
| 23 | 3-chlorophenylamine | 93.8 | 96.2 | (b) |
| 24 | 2-fluoro-4-methylphenylamine | | 96.6 | 97.7 |
| 25 | 2-fluoro-5-methylphenylamine | | 96.2 | 97.7 |
| | Comparative Tests | | | |
| 26 | 3-fluoro-2-methylphenylamine | | 93.9 | 95.3 |
| 27 | 4-fluoro-2-methylphenylamine | | 94.2 | 94.7 |
| 28 | 5-fluoro-2-methylphenylamine | | 93.6 | 94.9 |
| 29 | 2,3,4,5-tetrafluorophenylamine | | 94.3 | 95.1 |
| 30 | N-methyl-4-fluorophenylamine | | 95.1 | 95.2 |

(a) Concentrations based on wt % in Avgas
(b) Not fully soluble at this concentration These data demonstrate that for halogen substituted phenylamines, the halogen may occupy the 2-position with no negative impact on octane boosting capability. This is in contrast to alkyl substituents in the 2-position wherein the data in Table 2 shows that 2-alkyl substituted phenylamines cannot boost octane values to 98 MON. Mixed alkyl and halogen substituted phenylamines can achieve 98 MON provided that the alkyl is not in the 2-position. This can be seen by comparing Tests 24 and 25 with Tests 27 and 28. Fully halogenated amines (Test 29) are not effective octane boosters. Also, N-alkyl substitution reduces the octane boosting effect of a halogenated phenylamine as can be noted from a comparison of Tests 21 and 30.

EXAMPLE 4

This example compares the octane boosting performance of aromatic amines according to this invention to other conventional octane boosters and also compares the incremental effect of combining such aromatic amines with conventional octane boosters. The respective octane boosters were blended in Avgas having a MON of 92.6. The results are shown in Tables 5 and 6.

TABLE 5

| Fuel | MON |
|---|---|
| Unleaded Avgas base fuel | 92.6 |
| Base fuel plus 10% MTBE[a] | 94.1 |
| Base fuel plus 0.34 g/l MHT[b] | 96.2 |

[a]methyl tertiary butyl ether
[b]methylcyclopentadienyl manganese tri-carbonyl, concentration in g manganese/l

TABLE 6

| Test No. | Wt % 3,5-Dimethyl-phenylamine | Base Fuel | Base Fuel Plus 10% MTBE | Base Fuel Plus 0.34 g/l MMT |
|---|---|---|---|---|
| 31 | 0 | 92.6 | 94.1 | 96.2 |
| 32 | 3 | 94.7 | 96.0 | 97.4 |
| 33 | 6 | 98.0 | 98.7 | 98.4 |
| 34 | 9 | 100.6 | — | — |

The data in Table 5 demonstrates that even high concentrations of MTBE and MMT cannot boost the MON of Avgas to 98. The 0.34 g/l concentration of MMT is in excess of the 0.06 to 0.1 g g/l recommended for automotive fuel. Higher concentrations result in operational problems such as spark plug fouling and valve seat pitting. As seen from the data in Table 6, the addition of 3,5-dimethylphenylamine to Avgas containing 10 wt % MTBE or 0.34 g/l of MMT result in only slight incremental benefits over the base fuel without MTBE or MMT. In fact at 6 wt % 3,5-dimethylphenylamine, the incremental benefit is nearly gone.

EXAMPLE 5

This example provides a comparison between the octane boosting performance of substituted phenylamines and N-methylphenylamines in a motor gasoline versus their performance in an aviation gasoline. A fuel was blended according to Example III of U.S. Pat. No. 2,819,953. This fuel which contains 20 vol % toluene, 20 vol % diisobutylene, 20 vol % isooctane and 40 vol % n-heptane was stated by patentees in Example XIX to be representative of average commercial gasolines. Table 7 provides a comparison of performance of various phenylamines in motor gasoline versus aviation gasoline.

TABLE 7

| Test No. | Component | MON in Fuel A (a) Concentration (c) 0 | 6 | MON in Fuel B (b) Concentration (c) 0 | 6 |
|---|---|---|---|---|---|
| 35 | N-methylphenylamine | 71.4 | 87.0 | 92.6 | 94.7 |
| 36 | phenylamine | 71.4 | 85.8 | 92.6 | 98.3 |
| 37 | N-methyl-4-fluoro-phenylamine | 71.4 | 86.2 | 92.6 | 95.1 |
| 38 | 4-fluorophenylamine | 71.4 | 84.5 | 92.6 | 96.8 |
| 39 | N-methyl-2-fluoro-4-methylphenylamine | 71.4 | 81.2 | 92.6 | 94.5 |
| 40 | 2-fluoro-4-methyl-henylamine | 71.4 | 82.6 | 92.6 | 96.6 |

(a) Motor gasoline per Example III of U.S. Pat. No. 2,819,953, MON is 71.4
(b) Aviation gasoline per Example 1
(c) Concentration in wt % based on motor gasoline or aviation gasoline The data in Table 7 demonstrates that the best octane boosting performance for a relatively low octane motor gasoline is achieved using the N-methylphenylamines of Tests 35 and 37 wherein an octane boost of 15.6 and 14.8, respectively, is achieved. In contrast, these same amines in a relatively high octane aviation gasoline achieve an octane boost of only 2.1 and 2.5, respectively, and cannot reach the 98 octane level even if concentrations are increased. This is shown in Test 2 (Example 1) and Test 30 (Example 3). Thus one cannot predict the octane boosting performance of aromatic amines in aviation gasolines based upon their performance in motor gasoline.

What is claimed is:

1. An unleaded aviation fuel composition having a motor octane number of at least about 98 for piston driven aircraft which comprises:

(1) unleaded aviation gasoline base fuel having a motor octane number of 90–93, and (2) an amount of at least one aromatic amine effective to boost the motor octane number of the base fuel to at least about 98, said aromatic amine having the formula

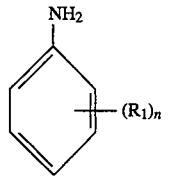

(I)

wherein $R_1$ is $C_1$–$C_{10}$ alkyl and n is an integer from 0 to 3 with the proviso that $R_1$ cannot occupy the 2- and 6-positions on the aromatic ring.

2. The composition of claim 1 wherein $R_1$ is $C_1$–$C_5$ alkyl.

3. The composition of claim 1 wherein n is 1 to 2.

4. The composition of claim 1 wherein the concentration of aromatic amine is from 4 to 20 wt %, based on gasoline.

5. The composition of claim 4 wherein the concentration of aromatic amine is from 5 to 15 wt %, based on gasoline.

6. The composition of claim 1 wherein the aromatic amine is selected from the group consisting of 3,5-dimethylphenylamine, 3,4-dimethylphenylamine, 3-methylphenylamine, 3-ethylphenylamine, 4-ethylphenylamine, 4-isopropylphenylamine and 4-t-butylphenylamine.

7. An unleaded aviation fuel composition having a motor octane number of at least about 98 for piston driven aircraft which comprises:

(1) unleaded aviation gasoline base fuel having a motor octane number of 90–93, and (2) an amount of at least one aromatic amine effective to boost the motor octane number of the base fuel to at least about 98, said aromatic amine being a halogen substituted phenylamine or a mixed halogen and $C_1$–$C_{10}$ alkyl substituted phenylamine with the proviso that the alkyl group cannot occupy the 2- or 6-positions on the phenyl ring.

8. The composition of claim 7 wherein the halogen is Cl or F.

9. The composition of claim 7 wherein the concentration of aromatic amine is from 4 to 20 wt %, based on gasoline.

10. A method for preparing an unleaded aviation fuel composition having a motor octane number of at least about 98 for use in piston driven aircraft which comprises adding to an unleaded aviation base fuel an amount of the aromatic amine of claims 1 and 7 effective to boost the motor octane number to at least about 98.

11. A method for operating a piston driven aircraft with an unleaded fuel which comprises operating the piston driven aircraft with an unleaded aviation gasoline base fuel containing an effective amount of the aromatic amine of claims 1 and 7 effective to boost the motor octane number of the base fuel to at least about 98.

* * * * *